US011162156B2

(12) United States Patent
Magadoux

(10) Patent No.: US 11,162,156 B2
(45) Date of Patent: Nov. 2, 2021

(54) METHOD AND DEVICE FOR COOLING A STEEL STRIP TRAVELLING IN A CONTINUOUS LINE COOLING SECTION

(71) Applicant: FIVES STEIN, Maisons Alfort (FR)

(72) Inventor: Eric Magadoux, Maisons-Alfort (FR)

(73) Assignee: FIVES STEIN

( * ) Notice: Subject to any disclaimer, the term of this patent is extended or adjusted under 35 U.S.C. 154(b) by 97 days.

(21) Appl. No.: 16/496,221

(22) PCT Filed: Mar. 22, 2018

(86) PCT No.: PCT/FR2018/050705

§ 371 (c)(1),
(2) Date: Sep. 20, 2019

(87) PCT Pub. No.: WO2018/172713

PCT Pub. Date: Sep. 27, 2018

(65) Prior Publication Data

US 2020/0017934 A1 Jan. 16, 2020

(30) Foreign Application Priority Data

Mar. 22, 2017 (FR) ..... 1752352

(51) Int. Cl.

| | |
|---|---|
| ***C21D 1/60*** | (2006.01) |
| ***C23C 2/40*** | (2006.01) |
| ***C21D 9/573*** | (2006.01) |
| ***C21D 1/667*** | (2006.01) |
| ***C21D 8/02*** | (2006.01) |
| ***C23G 1/08*** | (2006.01) |
| ***C23G 3/02*** | (2006.01) |

(52) U.S. Cl.

CPC ..... *C21D 9/573* (2013.01); *C21D 1/60* (2013.01); *C21D 1/667* (2013.01); *C21D 8/0205* (2013.01); *C23C 2/40* (2013.01); *C23G 1/088* (2013.01); *C23G 3/023* (2013.01); *C23G 3/028* (2013.01)

(58) Field of Classification Search

CPC ..... C21D 9/573; C21D 1/60; C21D 1/667; C21D 8/205; C23C 2/40; C23G 1/088; C23G 3/023; C23G 3/028

See application file for complete search history.

(56) References Cited

U.S. PATENT DOCUMENTS

| | | | | |
|---|---|---|---|---|
| 3,729,417 A | | 4/1973 | Hashimoto et al. | |
| 4,561,911 A | * | 12/1985 | Tanikawa | C21D 1/60 148/638 |
| 10,041,140 B2 | * | 8/2018 | Genaud | C23G 3/027 |

(Continued)

FOREIGN PATENT DOCUMENTS

| | | | | |
|---|---|---|---|---|
| FR | 2355914 A1 | | 1/1978 | |
| JP | S63192820 A | | 8/1988 | |
| WO | WO-2015083047 A1 | * | 6/2015 | C23C 2/06 |

OTHER PUBLICATIONS

International Search Report from PCT/FR2018050705, dated Jun. 4, 2018, pp. 1-6.

*Primary Examiner* — Scott R Kastler
(74) *Attorney, Agent, or Firm* — The Belles Group, P.C.

(57) ABSTRACT

Process and device for cooling a steel strip (1) running through the cooling section (2) of a continuous line, whereby cooling is achieved by projecting the strip with an aqueous solution of formic acid with a concentration of formic acid between 0.1% and 6%, and preferably between 0.5% and 2%.

10 Claims, 1 Drawing Sheet

(56) References Cited

U.S. PATENT DOCUMENTS

| | | | | |
|---|---|---|---|---|
| 2015/0315512 | A1* | 11/2015 | Hasegawa | C10M 135/28<br>508/156 |
| 2016/0304984 | A1 | 10/2016 | Genaud | |
| 2020/0017934 | A1* | 1/2020 | Magadoux | C21D 1/60 |
| 2020/0095652 | A1* | 3/2020 | Clin | C21D 1/60 |

* cited by examiner

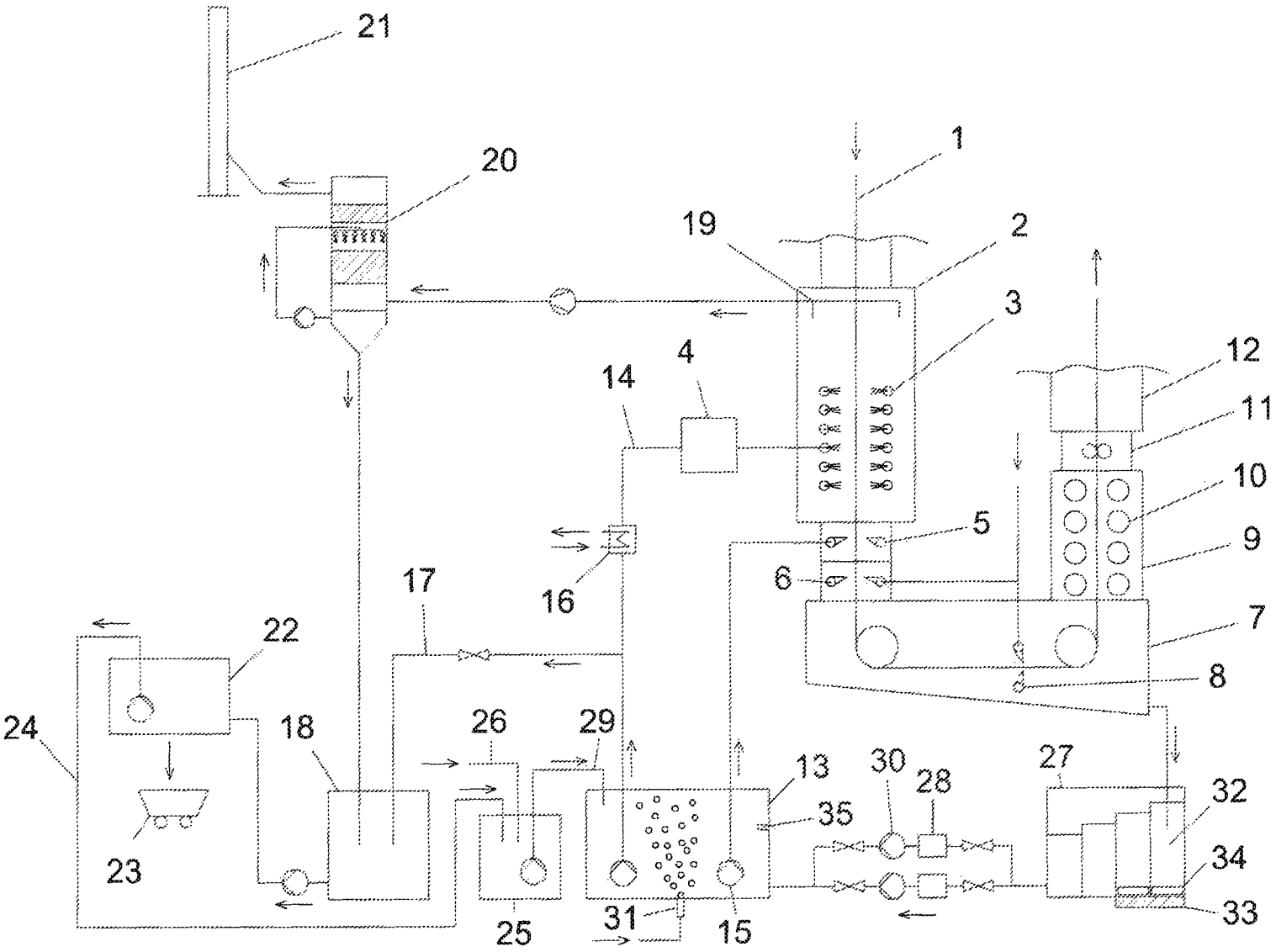
1
2
3
4
5
6
7
8
9
10
11
12
13
14
15
16
17
18
19
20
21
22
23
24
25
26
27
28
29
30
31
32
33
34
35

METHOD AND DEVICE FOR COOLING A STEEL STRIP TRAVELLING IN A CONTINUOUS LINE COOLING SECTION

CROSS-REFERENCE TO RELATED PATENT APPLICATIONS

The present application is a U.S. national stage application under 35 U.S.C. § 371 of PCT Application No. PCT/FR2018/050705, filed Mar. 22, 2018, which claims priority to French Patent Application No. 1752352, filed Mar. 22, 2017. The disclosures of the aforementioned priority applications are incorporated herein by reference in their entireties.

BACKGROUND OF THE INVENTION

The invention relates to wet cooling sections for continuous annealing or galvanizing lines for steel strips. By galvanizing, this description intends all dip-coating, whether the coating is of zinc, aluminum, alloys of zinc and aluminum, or any other type of coating. The steel strip typically enters these cooling sections at a temperature between 500° C. and 1000° C., at 800° C. for instance, and may exit at a temperature close to ambient or at an intermediate temperature.

In the state of the art there are two types of cooling technology for steel strips in continuous line applications: gas cooling and wet cooling.

Gas cooling, which typically involves blowing a high-speed, high hydrogen-content mix of $N_2H_2$ on the steel strip, can achieve cooling rates of up to 200° C./s for steel strips 1 mm thick. Since this process uses a reducing gas, the steel strip is not oxidized after passing through this type of cooling. The strip can then be galvanized in the absence of any intermediate chemical step, such as pickling. However, since the cooling rate is limited to 200° C./s, gas cooling cannot produce steels with advanced mechanical and metallurgical properties that require higher cooling rates.

Wet cooling, by projecting water or a mixture of water and gas on the steel strip, or by immersing the strip in a water tank, can achieve cooling rates of the order of 1000° C./s for strips 1 mm thick. These cooling rates can produce steels with advanced mechanical and metallurgical properties. However, when water is used as a coolant, the strip is oxidized, making the use of this type of cooling impossible on a galvanizing line without an intermediate pickling stage.

The applicant's international application WO2015/083047 proposes the use of a solution with pickling or non-oxidizing properties in relation to iron and steel alloying elements for the cooling process, for instance a solution of formic acid at a pH lower than 5, which can achieve cooling rates of the order of 1000° C./s for strips around 1 mm thick without oxidizing the strip.

BRIEF SUMMARY OF THE INVENTION

One aim of the invention is to propose a cooling process for a steel strip that improves performance of processes in the state of the art.

Another aim of the invention is to propose a cooling process that is more efficient than processes in the state of the art.

Another aim of the invention is to propose a cooling process that is less onerous than processes in the state of the art.

At least one aim of the invention is achieved with a cooling process for a steel strip running through the cooling section of a continuous line, which projects on the steel strip in question with a projecting solution, said solution being a liquid or a mixture of a liquid and a gas, the proportion of liquid by volume in the mixture being for instance between 1% and 5%.

When the projecting solution is a liquid, the concentration of formic acid in the said solution is between 0.1% and 6% by mass. When a mixture of a liquid and a gas is projected, the liquid within the said mixture has a concentration of formic acid that is also between 0.1% and 6% by mass. The gas in the projecting mixture is advantageously an inert gas, for example nitrogen or hydrogenated nitrogen.

DETAILED DESCRIPTION OF THE INVENTION

Tests have been carried out by the applicant on different types of steel, standard steels and steels alloyed with classic alloy elements such as manganese and silicon, with the aim of determining the ideal concentration of formic acid. These tests involve, for instance, placing a 100 mm×40 mm×1 mm sample between two connectors and bringing it quickly to a temperature of 800° C., in an atmosphere of $N_2H_2$ at 5% $H_2$ and a dew-point of −60° C., by passing an electric current through the sample. A solution of formic acid is then projected onto the sample during a set time so that it reaches a temperature of 50° C. On completion of the acid solution spraying, the sample is reheated to a temperature of 80° C. while being blowed with $N_2H_2$ at 5% $H_2$ and a dew-point of −60° C. These tests concluded that a formic acid solution with a concentration of between 0.1% and 6% by mass of the solution is sufficient to obtain a steel strip that can be galvanized without needing intermediate chemical treatment. The concentration of formic acid in the liquid solution is adjusted according to the steel's content of alloying elements with high redox potential, such as aluminum, manganese or silicon. The higher this content, the stronger the concentration of formic acid in the solution.

Advantageously, the concentration of formic acid is between 0.1% and 5.5%, advantageously between 0.1% and 5%, advantageously between 0.1% and 4.5%, advantageously between 0.1% and 4%, advantageously between 0.1% and 3.5%, advantageously between 0.1% and 3%, advantageously between 0.1% and 2.5%, advantageously between 0.15% and 2.5%, advantageously between 0.2% and 2.5%, advantageously between 0.3% and 2%, advantageously between 0.35% and 2.5%, advantageously between 0.4% and 2.5%, advantageously between 0.45% and 2.5% by mass of the solution. More advantageously, the concentration of formic acid is between 0.46% and 2.4%, advantageously between 0.47% and 2.3%, advantageously between 0.48% and 2.2%, advantageously between 0.49% and 2.1% by mass of the solution. Even more advantageously, the concentration of formic acid is between 0.5% and 2% by mass of the solution.

Advantageously, it was noted that the use of a formic acid solution with a concentration of between 0.5% and 2% by mass of the solution can be used to process grades of steel with low oxidation sensitivity, for example with low manganese, aluminum or silicon content.

Advantageously, the solution to be projected has a pH between 1.5 and 3.

The solution of formic acid used to quickly cool the strip, for example in 1 to 3 seconds, means no other chemical treatment of the strip is needed after it has been cooled. Nor does it require the strip to be rinsed with water after rapid cooling. Only one drying process can be done. It is therefore particularly advantageous for galvanizing lines, since the strip can be dipped in the zinc bath immediately after wet cooling, following a simple drying process.

Formic acid is the simplest of the carboxylic acids. Given its very simple chemical composition, the risk of creating complex carbon deposits on the surface of the steel strip or the equipment walls, which would prevent the implementation of a galvanizing stage without further intermediate treatment, is very limited. More complex acids, such as citric acid, can leave significant carbon deposits on the strip which may prevent a proper galvanizing.

When the hot steel strip is cooled by the solution, two independent chemical reactions take place:

a thermal decomposition of the solution, a chemical reaction between the strip and the solution and between the strip and the products of the thermal decomposition.

Formic acid, also known as methanoic acid-chemical formula HCOOH or $CH_2O_2$, and products of its decomposition, possess highly reducing properties that are ideal for the invention's application.

Indeed, at low temperatures, formic acid decomposes by decarboxylation into water and carbon monoxide in the following reaction:

$$HCOOH \rightarrow H_2O + CO$$

At higher temperatures, from around 150° C., formic acid decomposes by dehydration into dihydrogen and carbon dioxide in the following reaction:

$$HCOOH \rightarrow H_2 + CO_2$$

Once projected, the projecting solution can be a mist, or a water knife, or take other forms.

When liquid, decomposition of formic acid takes place mostly through decarboxylation, whereas it takes place mostly through dehydration when formic acid is in gas form.

In a particular application, the solution can be projected on the steel strip by spraying.

In both cases, the decomposition of formic acid produces reducing gases, either CO on the one hand, or $CO_2$ and $H_2$ on the other.

The solution to be projected is by preference aqueous. One advantage of an aqueous solution, over other solutions, is lower environmental impact, because it does not produce toxic or harmful waste when used. An aqueous solution is also less onerous than other solutions.

For preference, the aqueous solution to be projected can mainly comprise demineralized water. This way, deposits on the steel strip are further limited. This solution does not produce waste counter to environmental standards in steel producing countries, nor does it involve an excessive surcharge per ton of steel produced.

Advantageously, part of the solution produced by the thermo-chemical reaction of the projected solution and the steel strip is recovered in a recirculation unit, preferably a recirculation tank, and the solution to be projected is taken from a projecting unit, preferably from a projecting tank, which is linked to the recirculation unit. In this way, the projected solution can be re-used and so operational costs are minimized.

For example, for the production of standard steels, the flow rate of solution to be used to cool the strip is between 200 and 1000 $m^3/h$, and more generally around 500 $m^3/h$. Only a small proportion of the projected solution is altered by its chemical reaction with the steel strip and thermal decomposition. So as not to generate prohibitive consumption and production costs, it is important to reuse, even recycle a major proportion of this solution. Advantageously, at least 50% of the solution is recycled. More advantageously, at least 60%, advantageously at least 70%, advantageously at least 80%, advantageously at least 90% of the solution is recycled. With a more advantageous arrangement, at least 91%, advantageously at least 92%, advantageously at least 93%, advantageously at least 94%, advantageously at least 95%, advantageously at least 96%, advantageously at least 97%, advantageously at least 98%, advantageously at least 99% of the solution is recycled. With an even more advantageous arrangement, 100% of the solution is recycled.

Interaction of the formic acid solution in its liquid or gaseous phase, as well as its decomposition products in liquid or gaseous phase, with the steel strip initiates reactions that are not easily understood, particularly because of their rapidity and unusual temperature levels. The kinetics of the interactions between the present elements is also made complex because of the vaporization of the solution on contact with the strip and the resulting Leindenfrost effect. The contribution of chemical reactions between the gaseous phases and liquid phases, created by the acid solution and the strip, to the effect observed on the surface of the strip is difficult to quantify using an experimental approach.

Advantageously the invention's process can include a continuous or periodic check, for instance hourly, of the solution in the recirculation unit, said check including a measurement of at least one physico-chemical datum of the said solution—from the group including pH, density and formic acid concentration—or a combination of these physico-chemical data, and, when this measurement not fall within a predetermined range of tolerance, a predetermined volume of the solution in the recirculation unit is drawn off and the same predetermined volume of a formic acid solution is injected into the projection unit (13), said predetermined volume of formic acid solution injected having a concentration of formic acid such that the liquid solution to be projected, following the injection, has a concentration of formic acid between 0.1% and 6% by mass. Advantageously, the liquid solution to be projected, after injection, has a concentration of formic acid between 0.1% and 5.5%, advantageously between 0.1% and 5%, advantageously between 0.1% and 4.5%, advantageously between 0.1% and 4%, advantageously between 0.1% and 3.5%, advantageously between 0.1% and 3%, advantageously between 0.1% and 2.5%, advantageously between 0.15% and 2.5%, advantageously between 0.2% and 2.5%, advantageously between 0.3% and 2%, advantageously between 0.35% and 2.5%, advantageously between 0.4% and 2.5%, advantageously between 0.45% and 2.5% by mass. More advantageously, the liquid solution to be projected, after injection, has a concentration of formic acid between 0.46% and 2.4%, advantageously between 0.47% and 2.3%, advantageously between 0.48% and 2.2%, advantageously between 0.49% and 2.1% by mass. Even more advantageously, the liquid solution to be projected, after injection, has a concentration of formic acid between 0.5% and 2% by mass. The predetermined volume of the solution drawn off from the recirculation unit is determined according to the difference in formic acid concentration between the value measured, the minimum value in the predetermined range of tolerance and the concentration of formic acid in the injected solution, so that the projected solution is once again at the desired level of concentration.

Thus continuous measurement of the formic acid solution's performance ensures that it remains within the predetermined range of tolerance. The range of tolerance is for instance +/−10% of the set point value, whether this is, for instance, a formic acid concentration value, a density value or a pH value.

The concentration of formic acid and the range of tolerance can be adjusted according to the alloying elements of the steel constituting the strip, particularly their sensitivity to oxidation.

The concentration of formic acid and the range of tolerance can be adjusted according to the configuration of the line, its operating mode and the nature of the steels processed, according to whether the latter are more or less inclined to form oxides on the surface of the strip.

The concentration of formic acid and the range of tolerance can for example be determined by tests carried out on samples which are subjected to a thermal cycle representative of those occurring on the line.

The recirculation system enables reduced consumption of formic acid. However, the solution drawn off is lost. This is why the invention proposes, using a particular assembly, to recycle the solution drawn off.

On contact with the steel and oxides created by water molecules, the formic acid reacts as follows:

$$2CH_2O_2+FeO\rightarrow(CHO_2)_2Fe+H_2O$$

The solution drawn off can then be treated through oxidation of the $(CHO_2)_2Fe$ using hydrogen peroxide, also called oxygenated water in this description, to produce the following reaction:

$$2(CHO_2)_2Fe+H_2O_2+2CH_2O_2\rightarrow2(CHO_2)_3Fe+2H_2O$$

After the formation of ferric formate, a second reaction can take place, regenerating the formic acid and creating iron (III) hydroxides:

$$(CHO_2)_3Fe+3H_2O\rightarrow3CH_2O_2+Fe(OH)_3$$

The reaction presented here is for iron oxide, but similar reactions take place with the oxides of the alloying elements.

A particular aspect of the invention means the solution drawn off is treated through oxidation with oxygenated water, then filtered to extract the hydroxides of iron (III) and other alloying elements, the solution injected coming from a recirculation of the filtered solution or a new solution. By new solution, this description intends a solution with a formic acid concentration of between 0.1% and 6% by mass of the solution. Advantageously, the new solution has a concentration of formic acid between 0.1% and 5.5%, advantageously between 0.1% and 5%, advantageously between 0.1% and 4.5%, advantageously between 0.1% and 4%, advantageously between 0.1% and 3.5%, advantageously between 0.1% and 3%, advantageously between 0.1% and 2.5%, advantageously between 0.15% and 2.5%, advantageously between 0.2% and 2.5%, advantageously between 0.3% and 2%, advantageously between 0.35% and 2.5%, advantageously between 0.4% and 2.5%, advantageously between 0.45% and 2.5% by mass of the solution. More advantageously, the new solution has a concentration of formic acid between 0.46% and 2.4%, advantageously between 0.47% and 2.3%, advantageously between 0.48% and 2.2%, advantageously between 0.49% and 2.1% by mass of the solution. Even more advantageously, the new solution has a concentration of formic acid between 0.5% and 2% by mass of the solution.

Thus the solution drawn off may be processed with oxygenated water to obtain a mixture of formic acid and iron (III) hydroxide. This mixture can then be filtered to separate the formic acid from the iron (III) hydroxides.

The processed and filtered formic acid can be reused and re-injected into the circuit. The advantage of this method is the ability to use the precise dose of oxygenated water necessary to react with the quantity of iron (III) hydroxide in the solution. It allows not only to control the chemical reaction so that all the oxygenated water is consumed, but above all to get an almost instantaneous reaction.

The system therefore mainly consumes oxygenated water, and the only waste products, except gas emissions, are hydroxides of iron (III) and of the other alloying elements in the steel strips.

The formic acid solution can be fully or partly recirculated.

Oxidation with oxygenated water can be used to re-establish the desired concentration of formic acid. Filtration can enable the extraction of metallic oxides, for instance using a filter press. So waste products consist only of hydroxides of iron (III) and of other metal alloying elements.

The efficiency of this solution, and so the strip's aptitude to be galvanized, can be improved by removing the dissolved oxygen from the solution. Indeed, dissolved oxygen present in the solution is a source of oxidation of the strip. By removing this source of oxidation, the surface condition of the strip can only be improved.

An advantageous characteristic of the process using the invention means the solution drawn off of the recirculation unit can undergo a deoxygenation process before being projected.

Advantageously, the level of dissolved oxygen remaining in the projection solution can be below 1 ppm.

The dissolved oxygen can be removed from the solution using a system of membranes swept with nitrogen on one side and with vacuum extraction on the other side. Alternatively, the dissolved oxygen can be removed from the solution by bubbling nitrogen, or another inert gas, through it to amplify natural deoxygenation.

In an advantageous version, the process can also include a collection of the vapors created when the projection solution is projected onto the steel strip, condensing said collected vapors, and injecting said condensed vapors into a fluid circuit from which the projected solution is drawn.

Vapor collection can be achieved using a vapor collector placed above a projection unit of the solution to be projected.

The gas resulting from the vapor condensation can be directed to a chimney.

The collected vapors can be condensed using a scrubbing tower.

A second aspect of the invention proposes a cooling device arranged to cool a steel strip passing through a cooling section of a continuous line, comprising arranged elements to carry out a cooling process as described above.

The elements of the device as per the invention may include a chamber containing a projection unit for the solution to be projected, preferably nozzles, arranged to project a liquid, or a mixture of gas and liquid, onto the steel strip.

The elements of the device may include, upstream of these nozzles, a membrane system arranged to extract the dissolved oxygen from the solution to be projected.

The elements of the device may include, at the exit of the chamber, in the direction of the strip running, a set of liquid knives arranged to remove the majority of run-off liquid from the strip.

The elements of the device may include, downstream of the liquid knives, a set of gas knives arranged to remove any remaining liquid from the strip.

The elements of the device may include, downstream of the chamber, and as necessary of the set of liquid knives, and as necessary of all or some of the set of gas knives, a return tank arranged to collect the coolant liquid projected by the nozzles. The return tank may be positioned beneath the passage of the strip as it exits the chamber.

The return tank may include a second set of gas knives arranged to remove any remaining liquid from the strip.

The elements of the device may include a recirculation tank and the means to transfer liquid from the return tank to the recirculation tank.

The means of liquid transfer may include a filter arranged to eliminate the metallic particles present in the solution.

The elements of the device may include supply circuits including a pump and exchanger to feed the projection unit.

The supply circuit may include a diversion circuit enabling some of the liquid pumped by the pump into the recirculation tank to be sent to another tank.

The elements of the device may include the means to activate diversion circuits, said means being activated when some of the liquid in the cooling section needs to be renewed to maintain its performance within a predetermined operating range.

The elements of the device may include a system of membranes arranged to deoxygenate the solution, said membranes being swept with nitrogen on one side and with vacuum extraction on the other side.

The membrane system may be positioned immediately upstream of the projection unit, and the pump may be place upstream of the membrane system, in which case, the formic acid solution management circuit does not need to be isolated from sources of oxygen.

The pump may also be placed between the membrane system and the projection system, which enables a lowering of pressure in the membranes.

The membrane system may be positioned on a recirculation loop onto the projection tank or between the projection tank and the recirculation tank.

When the membrane system is positioned with an input of demineralized water, the rest of the solution management circuit is preferably sealed to oxygen.

All the tanks may be gas-tight and swept with an inert atmosphere, preferably nitrogen.

The elements of the device may include a processing system in which the solution drawn off can be treated with oxygenated water.

The processing system may include a filter, for example a filter press, from which waste products may be removed by conveyors.

The processing system may include means to inject a solution exiting the filter into the projection tank.

The invention consists, besides the provisions described above, of a certain number of other provisions which will be more explicitly addressed hereafter, with reference to an example assembly described in relation to the attached drawing, but which is in no way limiting.

On this drawing, FIG. 1 is a schematic view of an assembly method for a cooling section as per the invention. This assembly method being in no way limiting, there may in particular be variations of the invention that only include a selection of the characteristics described below, as described or generalized, isolated from the other characteristics described, if this selection of characteristics is sufficient to confer a technical advantage or to differentiate the invention from the state of the art.

FIG. 1 shows a cooling section of a continuous galvanizing line comprising a first part 2 within which a steel strip 1 is running vertically from top to bottom and cooled with a liquid projection as per the invention. Nozzles 3, arranged on both sides of the strip 1 project the coolant liquid onto the strip. Upstream of these nozzles in a liquid circuit, a membrane system 4 extracts dissolved oxygen in the solution. Alternatively, a bubbling system 31 using nitrogen or another inert gas is placed in a projection tank 13 to amplify natural deoxygenation. The level of dissolved oxygen in the solution is measured in the projection tank 13 using a sensor 35. At the exit of area 2, in the direction of the strip running, there is a set 5 of liquid knives for removing the majority of run-off liquid from the strip. The set 5 of liquid knives is followed, in the direction of the strip running, by a set 6 of gas knives for removing the remaining liquid from the strip. The strip then passes through a return tank 7 where the coolant liquid projected by the nozzles 3 and set 5 of liquid knives is collected. In this tank, a second set 8 of gas knives is designed to remove any remaining liquid from the strip. The strip then passes through an area 9 where heating tubes 10 eliminate all traces of liquid on the strip. On leaving this area 9, the strip passes through an atmosphere sealing device 11 between wet areas 2, 7, 9 and areas 12 downstream in the direction of the strip running. In this atmosphere sealing device, gas injection and/or aspiration allow to improve atmosphere separation between the sections up and downstream of the sealing device.

The liquid projected onto the strip by the nozzles 3 and set 5 of liquid knives is collected in the return tank 7 then sent to the projection tank 13. For this purpose, the liquid is transferred from the return tank 7 to a recirculation tank 27. This tank is equipped with cascading compartments 32 to keep particles as much as possible in the first compartments. Electromagnets 33 placed under the tank 27, together with a system of drawers 34, can collect and remove metallic particles without draining the tank. The liquid then passes through a set 28 of external filters to eliminate residual metallic particles before being sent back to the projection tank 13 by means of a pump 30. The set 28 of external filters and the pump 30 are doubled-up so that these elements can be maintained without stopping the installation.

Supply circuits 14 including a pump 15 and a heat exchanger 16 allow to supply the nozzle rows 3 in area 2 with coolant liquid at the required pressure and temperature, using the liquid held in the projection tank 13. The supply circuits 14 include a diversion circuit 17 enabling some of the liquid pumped to tank 13 to be sent to another tank 18. Alternatively, the diversion circuit 17 is fed from the recirculation tank 27. The diversion circuit 17 is activated when some of the liquid in the cooling section needs to be renewed to maintain its performance within the desired operating range.

A vapor collector 19 is placed in area 2 above the nozzle rows 3. The vapors collected are sent to a wet scrubber 20 where they are condensed and sent to the tank 18. Exiting the scrubber, gas with the vapor removed is sent to a chimney 21.

The liquid collected in the tank 18 is sent to a processing assembly 22 where the used formic acid solution is dosed with oxygenated water to obtain a mixture of formic acid and hydroxides of iron (III) and of the steel's alloying elements. This mixture is then filtered with a filter press (not shown) to separate the formic acid from the iron (III) hydroxides, the latter being removed with conveyors 23. The re-generated formic acid is re-used and re-injected as a new solution using a circuit 24 into a tank 25. Fresh formic acid is also introduced into this tank 25 using a circuit 26.

The liquid collected in tank 25 can then be sent to the projection tank 13 using a circuit 29 with a pump (unnumbered) located in tank 25.

Of course, the invention is not limited to the examples described above and numerous adjustments can be made to these examples without moving outside the frame of the invention. Moreover, the invention's various characteristics, forms, variants and assembly methods can be linked to one another in different combinations to the extent that they remain compatible and do not exclude one another.

The invention claimed is:

1. A cooling process for a steel strip (1) running through the cooling section (2) of a continuous line, comprising projecting onto the steel strip a projecting solution, said projecting solution being a liquid solution or a mixture of a liquid solution and a gas, wherein the liquid solution has a formic acid concentration of between 0.1% and 6% by mass;

wherein the projecting solution has a pH between 1.5 and 3;

wherein the process further comprises recirculating the projecting solution after projection onto the steel strip and also including a continuous or periodic check of the projecting solution prior to being projected, said check including a measurement of at least one physico-chemical datum of the said solution—from the group consisting of pH, density and formic acid concentration, or a combination of these physico-chemical data, and, when this measurement does not fall within a predetermined range of tolerance, a predetermined volume of the projecting solution is drawn off and the same predetermined volume of a formic acid solution is injected into the projection unit (13), said predetermined volume of formic acid solution having a concentration of formic acid such that the projecting solution to be projected is of a concentration of formic acid between 0.1% and 6%; and wherein the projecting solution drawn off is treated through oxidation with oxygenated water, then filtered to extract hydroxides of iron (III) and other alloying elements.

2. The process of claim 1, wherein the liquid solution has a formic acid concentration of between 0.5% and 2% by mass.

3. The process of claim 1, wherein the projecting solution is projected onto the steel strip by spraying.

4. A cooling process for a steel strip (1) running through the cooling section (2) of a continuous line, comprising projecting onto the steel strip a projecting solution, said projecting solution being a liquid solution or a mixture of a liquid solution and a gas, wherein the liquid solution has a formic acid concentration of between 0.1% and 6% by mass;

wherein the projecting solution has a pH between 1.5 and 3;

wherein the process further comprises recirculating the projecting solution after projection onto the steel strip and also including a continuous or periodic check of the projecting solution prior to being projected, said check including a measurement of at least one physico-chemical datum of the said solution—from the group consisting of pH, density and formic acid concentration, or a combination of these physico-chemical data, and, when this measurement does not fall within a predetermined range of tolerance, a predetermined volume of the projecting solution is drawn off and the same predetermined volume of a formic acid solution is injected into the projection unit (13), said predetermined volume of formic acid solution having a concentration of formic acid such that the projecting solution to be projected is of a concentration of formic acid between 0.1% and 6%; and wherein the projecting solution drawn off is drawn off from a recirculation unit (13) and undergoes a deoxygenation process before being projected.

5. The process of claim 1, further including collecting vapor resulting from the projection of the projecting solution being projected onto the steel strip, condensing said collected vapors, and injecting said condensed vapors into a fluid circuit from which the projecting solution is drawn.

6. A cooling device arranged to cool a steel strip (1) running through a cooling section (2) of a continuous line, comprising elements arranged to carry out a cooling process as per claim 1.

7. The device of claim 6, further comprising a system of membranes (4) arranged to deoxygenate the projecting solution, said membranes being swept with nitrogen on one side and with vacuum extraction on the other side.

8. The process of claim 1, wherein the mixture of a liquid solution and a gas comprises $N_2H_2$.

9. The process of claim 8, wherein the mixture of a liquid solution and a gas further comprises $H_2$ at 5%.

10. The process of claim 9, wherein the mixture has a dew point of −60° C.

* * * * *